United States Patent [19]

Dupuis

[11] Patent Number: 4,884,686

[45] Date of Patent: Dec. 5, 1989

[54] ADJUSTABLE APPLIANCE COVERING

[76] Inventor: John R. Dupuis, 20330 Pinecrest, Taylor, Mich. 48180

[21] Appl. No.: 279,548

[22] Filed: Dec. 5, 1988

[51] Int. Cl.[4] ..... B61D 85/00

[52] U.S. Cl. ..... 206/320; 220/8; 220/4 F; 206/597; 229/DIG. 3

[58] Field of Search ..... 220/8, 4 F, 4 E, 412; 206/597, 320; 229/DIG. 3

[56] References Cited

U.S. PATENT DOCUMENTS

| | | | |
|---|---|---|---|
| 3,100,046 | 5/1963 | Wetmore et al. | 206/597 |
| 3,297,237 | 1/1967 | Fesco | 229/DIG. 3 |
| 3,371,815 | 3/1968 | Macomber | 206/597 |
| 3,887,102 | 6/1975 | Zarly | 220/8 |
| 4,019,634 | 4/1977 | Bonnot | 206/597 |
| 4,096,987 | 6/1978 | Rodish | 229/DIG. 3 |
| 4,385,695 | 5/1983 | Champlin et al. | 220/4 F |

*Primary Examiner*—Joseph Man-Fu Moy
*Attorney, Agent, or Firm*—Leon Gilden

[57] ABSTRACT

An adjustable appliance covering is set forth wherein four equally dimensioned side panels include a first end formed with hook and loop fasteners along a limited width thereof with a second end formed as a bifurcated end with one of the bifurcations pivotally mounted to the panel wherein the interior surfaces of the bifurcated portion are formed with companion hook and loop fasteners to associate with a companion first end of an adjacent panel. The panels are thereby adjustable to accommodate appliances of varying cross-sectional dimensions by selective positioning of a first end within a bifurcated second end. An overlying cover is formed with hook and loop fastener strips to cover the uppermost portion of an associated appliance and impart rigidity to the complete organization.

4 Claims, 1 Drawing Sheet

ADJUSTABLE APPLIANCE COVERING

BACKGROUND OF THE INVENTION

1. Field of the Invention

The field of invention relates to appliance covers, and more particularly pertains to a new and improved adjustable appliance covering wherein the same may be compactly stored during periods of non-use, and may be effectively and efficiently adjustably erected relative to an appliance to impart cushioning and protection to same.

2. Description of the Prior Art

The use of appliance coverings of various types are well known in the prior art. It may be appreciated that appliance coverings of the past have typically utilized pre-formed and pre-configured members for protection of a limited dimensioned appliance. Manufacturing and variations in appliance design and configuration has heretofore not effectively been accommodated by prior art appliance coverings, wherein the instant invention attempts to overcome such deficiencies by setting forth a multi-adjustable appliance covering to provide a relatively rigid surface formed with cushioning means thereon to accommodate a range of appliance dimensions. Examples of prior art devices include U.S. Pat. No. 655,308 to Robinson setting forth a mat device hingedly formed along diameters thereof for interfolding wherein the mat is of an essentially padded construction. The Robinson patent is of interest relative to the basic concept of providing covering protection that is compactly stored when not in use.

U.S. Pat. No. 1,533,973 to Cohen, et al., sets forth a quilted pad of waterproof construction wherein the pad is of a generally non-rigid material, but is of interest relative to the padding utilized to provide protection to an associated surface.

U.S. Pat. No. 2,870,464 to Lalick sets forth a protective blanket device wherein the same may be conveniently interfolded and provided with handles for transport of the device during periods of non-use.

U.S. Pat. No. 3,113,326 to Hyde, et al., wherein protective elastomeric-type material is sealingly enclosed within a protective envelope provided with extensions at opposite ends thereof wherein the extensions are provided for the securement and protection of hospital beds, cribs, and the like for securement about the beds to provide protection of the underlying mattress construction.

U.S. Pat. No. 4,514,870 to Tyler sets forth a fire resistant protective blanket to be utilized by individuals wherein the blanket is provided with a foam surface underlying a blanket wherein a lower pocket is upwardly depending to collect debris landing on the blanket material. The patent is of interest relative to multi-layered protective blankets and the like and is of interest limited to that feature alone.

As such, it may be appreciated that there is a continuing need for a new and improved adjustable appliance covering which addresses both the problems of storage and effectiveness in use, and in this respect the present invention substantially fulfills this need.

SUMMARY OF THE INVENTION

In view of the foregoing disadvantages inherent in the known types of appliance coverings now present in the prior art, the present invention provides an adjustable appliance covering wherein the same may be compactly stored in a layered relationship during periods of non-use and may be further effectively and adjustably positioned about an appliance to be covered when needed. As such, the general purpose of the present invention, which will be described subsequently in greater detail, is to provide a new and improved adjustable appliance covering which has all the advantages of the prior art appliance coverings and none of the disadvantages.

To attain this, the present invention comprises a series of not less than three but typically four engagement members formed with a generally planar central section with a pivoted planar flap at one end and a bifurcated end portion at its other end wherein the flap and bifurcated end portion are formed with cooperating hook and loop fasteners wherein the end flap may be positioned adjustably relative to the interior portion of a cooperating bifurcated end portion to adjust the cross-sectional dimensional configuration of the appliance covering. A top formed with downwardly disposed flexible connector formed with hook and loop fasteners to engage with hook and loop fasteners formed proximate upper edge portions of each engagement member to impart rigidity to the organization. Exterior surfaces of the adjustable appliance covering is formed of padded material for protection of an appliance positioned within a completed structure. When not in use, the engagement members on the top portion may be stacked in a laminate inter-relationship to provide a compact storage unit.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable appliance covering which has all the advantages of the prior art appliance coverings and none of the disadvantages.

It is another object of the present invention to provide a new and improved adjustable appliance covering which may be easily and efficiently manufactured and marketed.

It is a further object of the present invention to provide a new and improved adjustable appliance covering which is of a durable and reliable construction.

An even further object of the present invention is to provide a new and improved adjustable appliance covering which is susceptible of a low cost of manufacture with regard to both materials and labor, and which accordingly is then susceptible of low prices of sale to the consuming public, thereby making such adjustable appliance coverings economically available to the buying public.

Still yet another object of the present invention is to provide a new and improved adjustable appliance covering which provides in the apparatuses and methods of the prior art some of the advantages thereof, while simultaneously overcoming some of the disadvantages normally associated therewith.

Still another object of the present invention is to provide a new and improved adjustable appliance covering wherein the same is provided with engagement members formed with hingedly directed edge portions to accommodate companion engagement members adjustably to provide for parallelepiped configurations of varying cross-sectional dimensions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
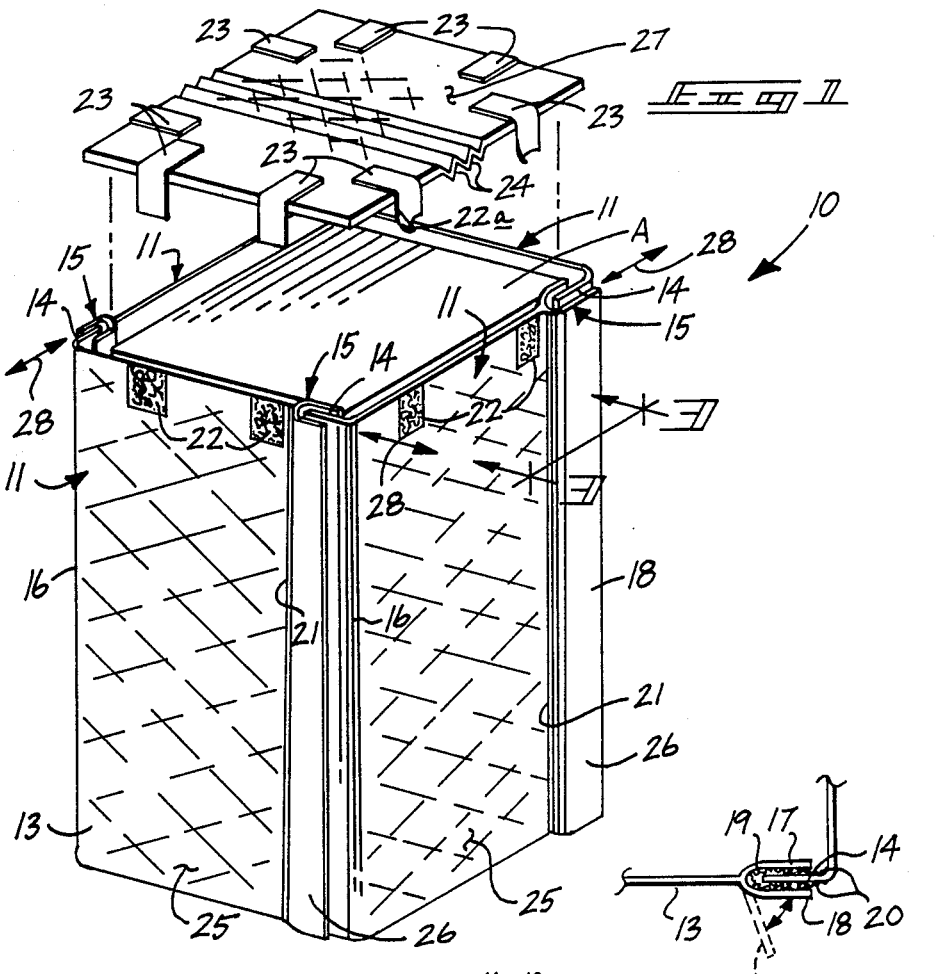
FIG. 1 is an isometric illustration of the instant invention.

With reference now to the drawings, and in particular to FIGS. 1 to 4 thereof, a new and improved adjustable appliance covering embodying the principles and concepts of the present invention and generally designated by the reference numeral 10 will be described.

More specifically, it will be noted that the adjustable appliance covering apparatus 10 essentially comprises a plurality of engagement members 11 formed of generally rigid material including end flaps 14 hingedly secured to a central planar portion 13. A top portion 12 of generally planar construction is securable to the parallelepiped formed by the interengagement of respective ends of a plurality of engagement members 11. As illustrated in FIG. 1, four engagement members 11 are utilized to form a generally rectangular parallelepiped configuration, but at least three engagement members 11 must be utilized to enclose an appliance "A" wherein typically four engagement members 11 are utilized to encompass a four-sided appliance, as is typically found in the industry. The top portion 12 is securable to the upper ends of respective engagement members 11 by associated connector strips (to be discussed in more detail below) to enhance the rigidity of the assembled adjustable appliance covering 10 over an associated appliance.

Each engagement member 11 comprises a generally planar central portion 13 including a hingedly associated end flap 14 along one side thereof, and a bifurcated end portion 15 along the opposite side thereof in generally parallel relationship to the end flap 14. The end flap 14 is associated to the central planar portion 13 by a first flap hinge 16 coextensively formed along the length of the engagement member 11 defining a first side of the central planar member with a second flap hinge 21 defining the opposite parallel second edge of the central planar portion 13.

Figure 3:
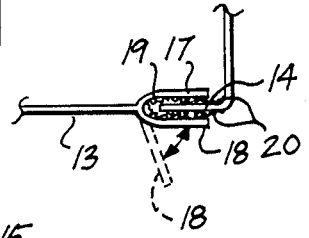
FIG. 3 is a cross-sectional view taken along the lines 3—3 of FIG. 1 in the direction indicated by the arrow.
Figure 2:
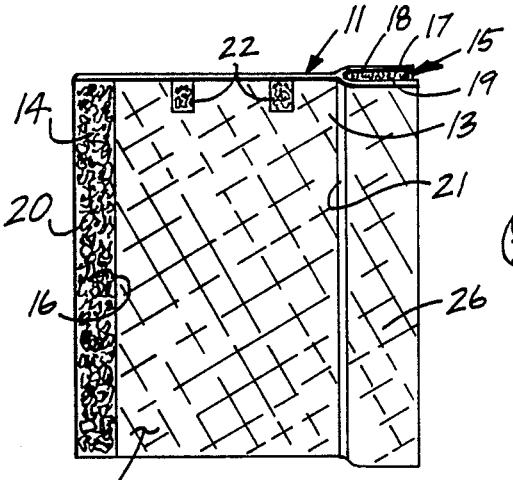
FIG. 2 is an isometric illustration of a single engagement member.

Each bifurcated end portion 15 includes an interior flap 17 rigidly and integrally formed to the central planar portion 13 with an exterior flap 18 pivotally connected to the central planar portion along the aforenoted elongate second flap hinge 21. Formed onto the interior surfaces of the bifurcated end portion 15 are first hook and loop connectors 19 adjustably associatable with second hook and loop connectors 10 formed on the interior and exterior surfaces of the aforenoted end flap 14. In this manner, each end flap 14 is insertable within the interior of a respective bifurcated end plate 15 a desired and adjustable amount to thereby define an exterior configuration conforming to the exterior configuration of an associated appliance "A". The pivotal association of each respective exterior flap 18 to a respective central planar portion 13, enables positioning of a respective end flap 14 of an adjacent engagement member 11 a predetermined amount within the interior of the bifurcated portion 15. By pivotally opening the exterior flap 18, as illustrated in FIG. 3, the respective end flap 14 of an adjacent engagement member may be inserted a desired distance within the interior of the bifurcated end portion 15 whereupon the exterior flap 18 is repositioned to its original first position, as indicated by the second directional arrow 29, for secure engagement of the end flap 14 within the interior of a respective bifurcated end portion 15. First directional arrows 28 in FIG. 1 illustrated the depth positioning of the end flaps 14 within the bifurcated end portions 15. The top portion 12 is formed with a plurality of flexible connector strips 23 securable to hook and loop connector portions 22 formed proximate upper edges of respective engagement members 11. The width of the hook and loop connector portions 22 are greater than the width of the companion flexible connector strips 23. A medially formed accordion pleat 24 is formed centrally of the top portion 12 whereupon the top portion 12 may be extended to accommodate adjustment of the respective engagement members 11, and in this manner the increased width of the hook and loop connector portions 22 accommodates expansion of the top portion 12.

Each engagement member 11 is formed with a first padded exterior surface 25 formed onto the central planar portion 13 with a second padded exterior surface 26 formed on an exterior surface of each respective exterior flap 18. A third padded exterior surface is formed onto the top surface of the top portion 12.

In this manner, it may be appreciated that the adjustable appliance covering 10 of the instant invention accommodates varying ranges of manufactured appliances "A" to be contained therewithin.

Figure 4:
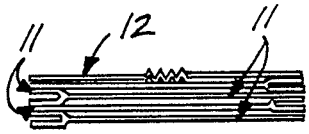
FIG. 4 is an orthographic view taken in elevation of the engagement members and top portion in a stacked relationship.

Reference to FIG. 4 illustrates the compact stacking of an adjustable appliance covering 10 when it is not in use wherein alternating end flaps 14 are positioned adjacent alternating bifurcated end portions of respective engagement members 11 to define a compact layered association of the various panels when positioned upon one another.

As to the manner of usage and operation of the instant invention, the same should be apparent from the above description, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An adjustable appliance covering comprising, a plurality of engagement members wherein each engagement member includes a central planar portion, and a first side portion, and a second portion, each of the first side portions are adjustable securable to the central planar portions, and an interior defined by each of the second side portions securably and adjustably received at a first side portion therewithin of an adjacent engagement member, and the inter-securing engagement members define a parallelepiped, and a top portion is securable to overlying top edges of said engagement members when said engagement members are securably connected to each other, and said top portion further includes a plurality of fastening means fixedly secured to said top portion and securable to companion fastening means on said engagement member to enhance rigidity of the appliance covering, and wherein each first side portion defines an end flap hingedly securable to said central planar portion, and each second side portion includes a bifurcated end portion including an interior flap rigidly secured to said central planar portion with an exterior flap hingedly secured to said central planar portion, and wherein each interior surface of said interior and exterior flaps includes hook and loop connectors selectively securable to second hook and loop connectors formed on interior and exterior surfaces of each end flap, and wherein said top portion includes a medially formed accordion hinge to enable expansion of said top portion to accommodate adjustment of said engagement members, and wherein the fastening means of said top portion includes a plurality of flexible strips fixedly secured to said top portion at one end thereof and formed with hook and loop fasteners at other ends thereof cooperative with hook and loop connector portions formed adjacent upper edge portions of each respective engagement member.

2. An adjustable appliance covering as set forth in claim 1 wherein a width defined by each hook and loop connector portion of each engagement member is greater than a width defined by each connector strip to accommodate expansion and contraction of said top portion relative to underlying engagement members when said top portion is secured to said engagement members.

3. An adjustable appliance covering as set forth in claim 2 wherein the hinge defined by each of said end flaps is formed parallel to the hinge defined by said exterior flap and wherein said hinges are coextensive along a length defined by each engagement member.

4. An adjustable appliance covering as set forth in claim 3 wherein the central portion includes a first padded exterior surface, and an exterior surface of each exterior flap includes a second padded portion.

* * * * *